US012807377B2

(12) United States Patent
Zimmerman et al.

(10) Patent No.: US 12,807,377 B2
(45) Date of Patent: Nov. 24, 2026

(54) CONTAINER, CLOSURE, AND METHODS OF MANUFACTURE AND USE

(71) Applicant: H.J. Heinz Company Brands LLC, Pittsburgh, PA (US)

(72) Inventors: Daniel M. Zimmerman, Glen Ellyn, IL (US); John Kevin Clay, Milford, CT (US); James E. McCay, Fairfield, CT (US)

(73) Assignee: H.J. Heinz Company Brands LLC, Pittsburgh, PA (US)

( * ) Notice: Subject to any disclaimer, the term of this patent is extended or adjusted under 35 U.S.C. 154(b) by 83 days.

(21) Appl. No.: 18/716,495

(22) PCT Filed: Dec. 8, 2022

(86) PCT No.: PCT/US2022/052242

§ 371 (c)(1),
(2) Date: Jun. 4, 2024

(87) PCT Pub. No.: WO2023/107613

PCT Pub. Date: Jun. 15, 2023

(65) Prior Publication Data

US 2025/0033841 A1 Jan. 30, 2025

Related U.S. Application Data

(60) Provisional application No. 63/288,363, filed on Dec. 10, 2021.

(51) Int. Cl.
*B65D 47/08* (2006.01)

(52) U.S. Cl.
CPC .. *B65D 47/0857* (2013.01); *B65D 2251/0025* (2013.01); *B65D 2251/0093* (2013.01)

(58) Field of Classification Search
CPC ..... B65D 47/0857; B65D 2251/0025; B65D 2251/0093; B65D 47/06
See application file for complete search history.

(56) References Cited

U.S. PATENT DOCUMENTS 2,964,208 A * 12/1960 Heyl ..... B65D 41/28 222/571
3,973,690 A 8/1976 Schneider
(Continued)

FOREIGN PATENT DOCUMENTS

CN 2837228 Y 11/2006
CN 110461724 A 11/2019
(Continued)

OTHER PUBLICATIONS

Image of the interior of a cap believed publicly available as early as Dec. 10, 2021.

(Continued)

*Primary Examiner* — James N Smalley
(74) *Attorney, Agent, or Firm* — Fitch, Even, Tabin & Flannery LLP

(57) ABSTRACT

A dispensing bottle is provided that includes a container body having a neck forming an opening and neck threads thereon. The dispensing bottle includes a closure cap having a skirt with corresponding threads to secure the closure cap to the container body. The dispensing bottle further includes a liner and a fitment having a base portion and a tube. The base portion is attached to the neck of the container body and includes at least one opening therethrough. The tube extends from the opening of the base portion and into the container body to form a fluid flow channel within the neck of the container body to the opening of the base portion and to form a serum well within the neck of the container body. The (Continued)

liner is sealed to a rim of the neck of the container body and/or the base portion of the fitment.

25 Claims, 13 Drawing Sheets

(56) References Cited

U.S. PATENT DOCUMENTS

| | | | | |
|---|---|---|---|---|
| 4,158,902 | A * | 6/1979 | Chernack | B65D 47/0819 220/838 |
| 6,164,503 | A | 12/2000 | Forsyth | |
| 6,477,743 | B1 | 11/2002 | Gross | |
| 6,689,279 | B1 | 2/2004 | Train | |
| 6,702,161 | B2 | 3/2004 | Adams | |
| 7,036,683 | B2 | 5/2006 | Dubach | |
| 7,549,547 | B2 | 6/2009 | Herr | |
| 8,496,129 | B2 | 7/2013 | Isogai | |
| 8,573,423 | B2 * | 11/2013 | McGeough | B65D 51/20 222/541.9 |
| 11,708,191 | B2 | 7/2023 | Silla | |
| 2004/0173644 | A1 | 9/2004 | Ramsey | |
| 2004/0217083 | A1 | 11/2004 | Mavin | |
| 2005/0184092 | A1 | 8/2005 | Illuzzi | |
| 2007/0251079 | A1 | 11/2007 | Pugne | |
| 2007/0267304 | A1 * | 11/2007 | Portier | B65D 83/0481 206/204 |
| 2009/0050648 | A1 | 2/2009 | Wisniewski | |
| 2010/0072231 | A1 | 3/2010 | Bloom | |
| 2013/0043277 | A1 | 2/2013 | Lepage | |
| 2015/0329233 | A1 | 11/2015 | Staples | |
| 2020/0071041 | A1 | 3/2020 | Sahara | |
| 2025/0011053 | A1 | 1/2025 | Ronaldo | |

FOREIGN PATENT DOCUMENTS

| | | | |
|---|---|---|---|
| CN | 210618954 | U | 5/2020 |
| JP | H0631247 | | 11/1994 |
| JP | 2010023873 | | 2/2010 |
| JP | 2010260589 | A | 11/2010 |
| JP | 2019011099 | | 1/2019 |
| WO | 2012138637 | | 10/2012 |
| WO | 2015105422 | | 7/2015 |
| WO | 2020132247 | | 6/2020 |
| WO | 2021055067 | | 3/2021 |

OTHER PUBLICATIONS

Patent Cooperation Treaty; International Search Report for International Application PCT/US2022/052246 mailed Apr. 20, 2023; 3 pages.

Patent Cooperation Treaty; International Preliminary Report on Patentability and Written Opinion for International Application PCT/US2022/052246 issued Jun. 5, 2024; 6 pages.

Patent Cooperation Treaty; International Search Report for International Application PCT/US2022/052242 mailed Apr. 26, 2023; 5 pages.

Patent Cooperation Treaty; International Preliminary Report on Patentability and Written Opinion for International Application PCT/US2022/052242 issued Jun. 5, 2024; 7 pages.

* cited by examiner

CONTAINER, CLOSURE, AND METHODS OF MANUFACTURE AND USE

CROSS-REFERENCE TO RELATED APPLICATION(S)

This application is the national phase of PCT/US22/52242 filed Dec. 8, 2022, which claims the benefit of U.S. Provisional Application No. 63/288,363, filed Dec. 10, 2021, which is incorporated by reference in its entirety.

FIELD

This disclosure relates generally to containers for fluids. More particularly, this disclosure relates to containers for dispensing fluid.

BACKGROUND

Product separation is an issue that arises with many fluid products that have two or more fluid types in a mixture. Product separation often results as the fluid product settles over time with a lower density fluid separating from a higher density fluid of the fluid product. For instance, a thin or relatively low viscosity, low density fluid may separate from the remainder of a fluid and rest on top of the remainder of the fluid. One example of such a fluid where product separation is prone to occur is ketchup. Over time, serum or water separates from the remainder of the ketchup fluid, with the serum or water rising to the top of the fluid mixture. Product separation is undesirable in many applications and particularly in applications where the fluid product is dispensed directly from a container where the user may not be aware that product separation has occurred. As a result of product separation, when a user dispenses the fluid from the fluid container, the low viscosity, low density fluid may be dispensed separately from the remainder of the product rather than as a mixed fluid product. Dispensing the lower viscosity fluid may result in increased splatter as the user dispenses the fluid from the fluid container. Moreover, the thin or lower viscosity fluids may more readily leak from the fluid container.

Some have attempted to address these problems by using a dispensing cap with a bottle that facilitates mixing of the fluid within the bottle as the fluid is dispensed. These dispensing caps, however, are often large in size, having intricate internal pieces and mixing channels within the closure cap. Such dispensing caps are generally expensive to manufacture and are overly large which makes them difficult to ship and store (e.g., take up too much shelf space in the store and/or at home).

DETAILED DESCRIPTION

Figure 1A:
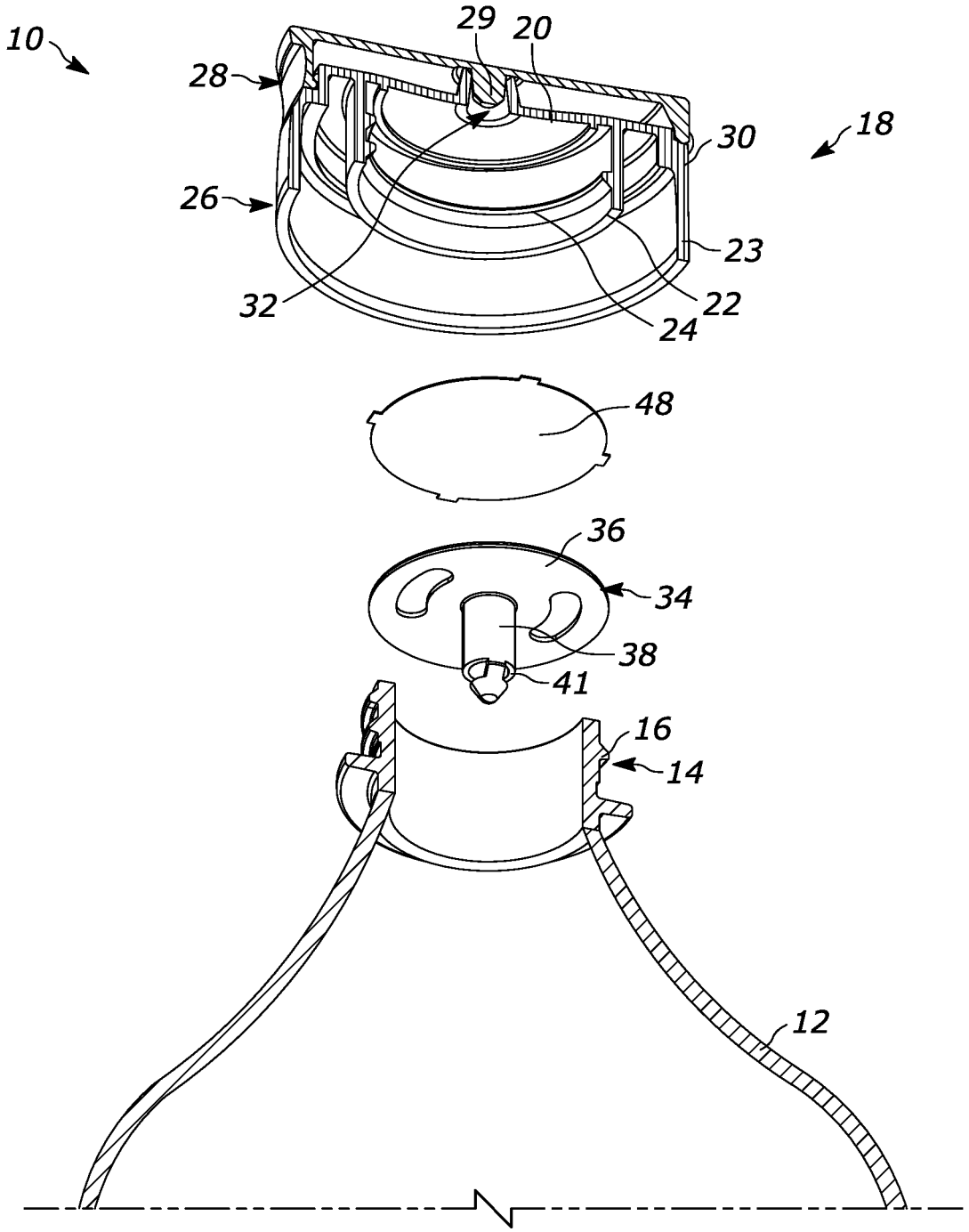
FIG. 1A is a partial cross-sectional exploded view of an upper portion of a dispensing bottle including a container body, a closure cap, a fitment, and a liner.

Described herein are systems, apparatus and methods for dispensing a fluid from a bottle, such as, consumer or food products including, e.g., condiments or drinks. In some embodiments, a bottle includes a fitment that is configured to facilitate dispensing of fully mixed product and prevent discharge of separated constituents, such as, e.g., watery serum. In some configurations, the dispensing bottle includes a serum well that captures or retains at least some of the separated serum, thereby preventing it from discharging from bottle, at least until this separated serum has been sufficiently mixed into a remainder of the fluid. While some previous solutions required complicated or large closure caps, others suffered from a decrease in functionality. For example, certain closure caps that prevented the discharge of separated serum, also required a very large internal pressure to eject the fluid therefrom, thereby requiring the consumer to apply a larger force to the outside of the dispensing bottle.

Various dispensing bottles 10 are provided herein that facilitate mixing of the constituent parts of a fluid contained therein prior to discharge from the dispensing bottle 10 and/or prevent separated fluid from being dispensed from a container body 12 of the dispensing bottle 10. In some illustrative embodiments, the dispensing bottle 10 includes a serum trap or serum well 44 for the separated fluid (e.g., serum) to flow into where the separated fluid is not able to flow directly out of the dispensing bottle 10 and be dispensed to the user without being mixed with a remainder of the fluid. For example, where serum or water has separated from the fluid (e.g., ketchup) within the dispensing bottle 10, as the dispensing bottle 10 is inverted, the serum or water flows into the serum well 44. The serum well 44 is formed by a tube 38 of a fitment 34 that extends into the container body 12 and serves as a snorkel that fluid from further into the container body 12 enters to be dispensed to the user. For example, where serum or water has separated from the fluid (e.g., ketchup), as the dispensing bottle 10 is inverted, the serum or water flows or is retained within into the serum well 44 and below the inlet opening 41 of the tube 38 of the fitment 34. The mixed or non-separated fluid flows on top of the serum within the serum well, trapping the separated fluid within the serum well and preventing the separated fluid from flowing into the inlet opening 41 of the tube 38 and along a fluid flow channel 42 of the tube 38 out of the container body 12. The mixed or non-separated fluid outside of the serum well 44 and above the inlet opening 41 of the tube 38 of the fitment, however, is able to flow into the fluid flow channel 42 of the tube 38 and out of the dispensing bottle 10.

In some configurations, by having the tube 38 of the fitment 34 extend into the neck of the container body 12, the dispensing bottle 10 may include a closure cap 18 with a relatively low profile while preventing separated fluid from being dispensed from the dispensing bottle 10. More particularly, the location of the tube 38 provides a serum well 44 at least partially disposed in the neck 14 of the container body 12. Thus, the closure cap of the dispensing bottle 10 may have a smaller size that is more easily shipped and/or stored. The dispensing bottle 10 also may be economically manufactured as it lacks intricate internal components that require specialized manufacture.

In addition, the dispensing bottle 10 also may include a closure cap 18 that prevents unintentional discharge of fluid therethrough. The dispensing bottle 10 may be stored while resting on the closure cap 18 or on the base of the container body 12. Therefore, the closure cap 18 typically includes structure to both sufficiently retain the fluid in the bottle 10 when the closure cap 18 is in a closed configuration and the container body 12 is disposed above or below the closure cap 18.

With respect to FIGS. 1A-1E, a dispensing bottle 10 is shown according to a first embodiment. The receptacle or container body 12 is a receptacle for receiving and storing fluid (e.g., thixotropic fluid), such as a fluid food product and other consumer fluid products. Examples of fluid food products include ketchup, mayonnaise, barbecue sauce, and mustard. Examples of other consumer fluid products include soap, detergent, lotion, shampoo, and conditioner. The container body 12 has a neck 14 defining an opening through which the container body 12 may be filled with fluid and through which the fluid may be dispensed from the container body 12. By one approach, the neck 14 of the container body 12 includes neck threads 16 disposed on the outer surface of the neck 14. The neck threads 16 may be used to secure the closure cap 18 to the neck 14 of the container body 12. The container body 12 may be formed of a plastic material, such as, polypropelene, polyethylene (e.g., HDPE, LDPE, LLDPE, MDPE, HMWPE), polyethylene terephthalate (PET), or other food grade plastic or polymer. The container body 12 may be transparent or translucent enabling a user to see through the container body 12, for example, to view the fluid of the container body 12 and/or determine the amount of fluid remaining in the container body 12. The container body 12 may be flexible enabling a user to squeeze the container body 12 to reduce the volume of the container body 12 and force fluid out of the container body 12 to dispense the fluid. The container body 12 may be configured to elastically rebound to its original shape when a user ceases to squeeze or apply a force to the container body 12.

In some embodiments, the closure cap 18 includes a base 26 and a flip-top lid 28 hingedly connected to the base 26 via hinge 30. The flip-top lid 28 may be moved between open (not shown) and closed positions about the hinge 30. The base 26 of the closure cap 18 includes a central member 20 with a dispensing opening 32 therein for fluid to flow through the closure cap 18 to dispense the fluid within the container body 12. The closure cap 18 may be attached to the neck 14 of the container body 12 and the flip-top lid 28 moved between open and closed positions to selectively permit the fluid to exit the container body 12. The flip-top lid 28 may prevent fluid from exiting the dispensing opening 32 when the flip-top lid 28 is closed and may permit fluid from exiting the dispensing opening 32 when the flip-top lid 28 is open. The flip-top lid 28 may include a projection 29 that closes or plugs the opening 32 when the flip-top lid 28 is in the closed position. The projection 29 may be at least partially inserted into the opening 32 to plug the opening 32. The projection 29 may be removed from the opening 32 when the flip-top lid 28 is moved toward the open position to thereby permit fluid to exit the opening 32.

The base 26 of the closure cap 18 includes an inner skirt 22 depending from the central member 20. The base 26 may further include an outer skirt 23 depending from the central member 20. The inner skirt 22 and the outer skirt 23 may be substantially concentric with the opening 32 of the base 26. The inner skirt 22 has skirt threads 24 disposed on an inner surface thereof that correspond to the neck threads 16 of the container body 12. The closure cap 18 may be secured to the container body 12 by threading the skirt threads 24 of the base 26 to the neck threads 16 of the neck 14 of the container body 12. The outer skirt 23 may depend from an outer edge of the central member 20. The outer skirt 23 may form a shell about the inner skirt 22 and the neck 14 of the container body 12. The closure cap 18 may be formed of a plastic material, such as, polypropelene, polyethylene (e.g., HDPE, LDPE, LLDPE, MDPE, HMWPE), PET, or other food grade plastic or polymer.

Figure 2A:
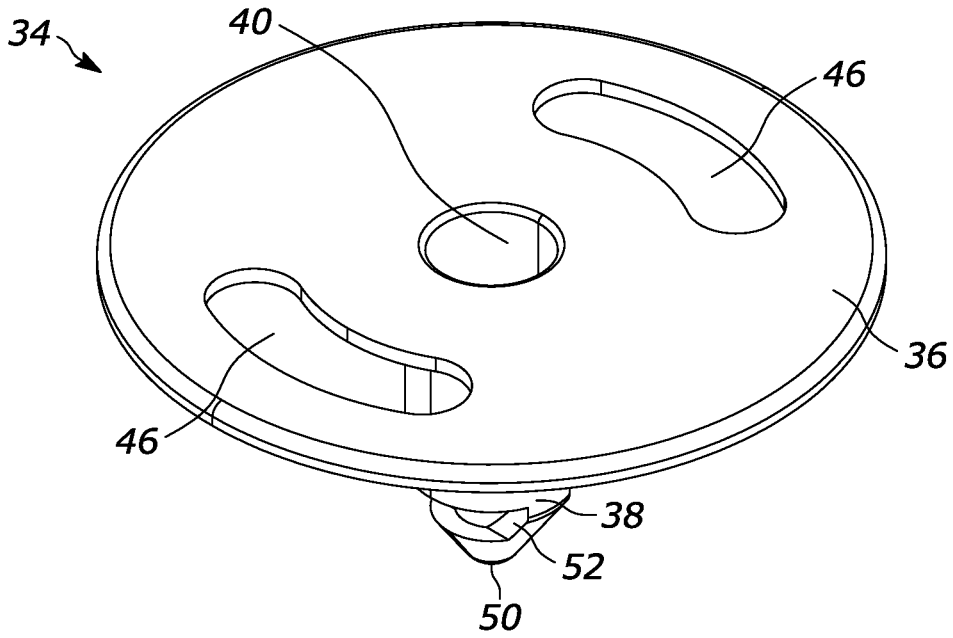
FIG. 2A is a top perspective view of the fitment of the dispensing bottle of FIG. 1A.
Figure 2B:
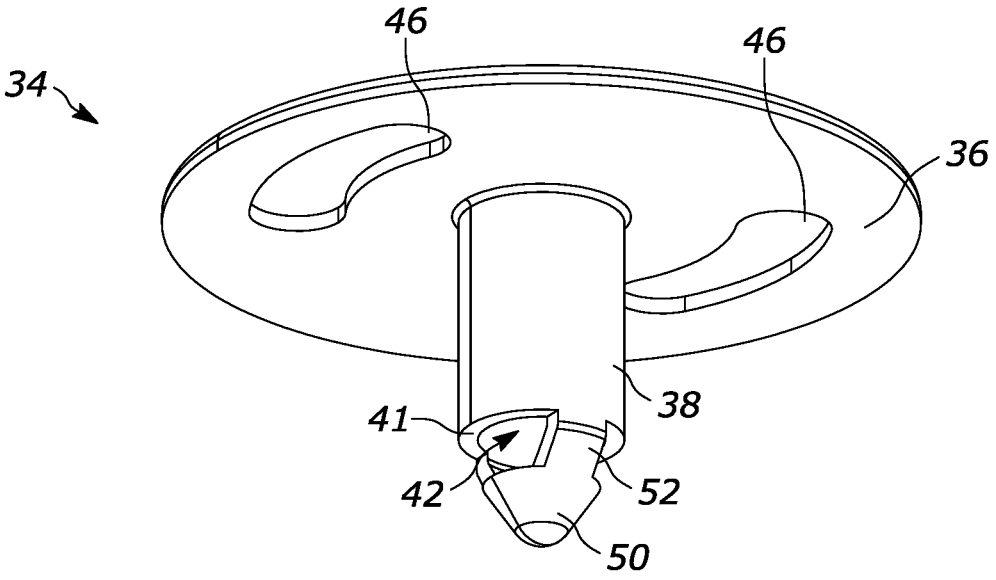
FIG. 2B is a bottom perspective view of the fitment of FIG. 2A.

With reference also to FIGS. 2A and 2B, the dispensing bottle 10 further includes a fitment 34 that may be secured to the neck 14 of the container body 12. The fitment 34 may be used to create a serum well 44 (see FIG. 1D) within the neck 14 of the container body 12 such that serum or separated fluid may be trapped in the serum well 44 and is not able to be dispensed from the dispensing bottle 10 (by being separated from the opening 41 of the tube that is in fluid communication with the opening 32). In one exemplary embodiment, the fitment 34 includes a flanged base portion 36 and a tube 38 extending from the base portion 36. By some approaches, the flanged base portion 36 is configured to be attached to the neck 14 of the container body 12. In the embodiment shown in FIG. 1A, the base portion 36 of the fitment 34 rests on an upper surface or rim of the neck 14 of the container body 12. In some embodiments, the fitment 36 is welded to the neck 14 by heat, for example, heat caused during induction sealing of a liner 48 described below. In other forms, an adhesive may be disposed between the rim of the neck 14 and the base portion 36 of the fitment 34 to secure the fitment 34 thereto. The base portion 36 includes at least one central opening 40 therethrough.

In some configurations, the tube 38 extends from the base portion 36 about the central opening 40 to an inlet opening 41. When the fitment 34 is secured to the container body 12, at least a portion of the tube 38 of the fitment 34 extends into the container body 12 (e.g., into the neck 14) such that the inlet opening 41 of the tube 38 is within the container body 12, disposed a distance from an opening defined by the upper surface or rim of the neck 14. In use, the tube 38 typically forms a fluid flow channel 42 within a portion of the neck 14 of the container body 12 from the inlet opening 41 to the opening 40 of the base portion 36 of the fitment 34. By positioning the inlet opening 41 within the neck 14 of the container body 12, the inlet opening 41 of the tube 38 receives fluid from further into the container body 12 rather than the fluid adjacent the base portion 36 of the fitment 34. The fitment 34 thereby forms the serum well 44 within the neck 14 of the container body 12 with the tube 38 serving as a snorkel for dispensing fluid from further inside the container body 12.

The serum well 44 typically includes the volume of fluid within the dispensing bottle 10 disposed radially outward of the tube 38 that is not able to flow into the fluid flow channel 42 through the inlet opening 41. For instance, when the dispensing bottle 10 is inverted to dispense the fluid (or is resting stably on its closure cap), the separated fluid (e.g., serum, water) flows to or pools at the base portion 36 of the fitment 34. The separated fluid is thus radially outward of the tube 38 of the fitment 34 or outside the fluid flow channel 42 and, where the volume of the serum well 44 is greater than the volume of the separated fluid, the separated fluid is disposed below the inlet opening 41 of the tube 38 of the fitment (when the dispensing bottle 10 is inverted) and is not able to enter the fluid flow channel 42 through the inlet opening 41. The size of the serum well 44 may be adjusted by adjusting the length and diameter of the tube 38. As examples, the tube 38 may have a length in the range of about 6 mm to about 25 mm. In one specific example the tube 38 may have a length of 10 mm. As another specific example the tube 38 may have a length of 14 mm. The serum well 44 may have a volume in the range of about 2 mL to about 15 mL, and in one specific example 5 mL. As another specific example, the serum well 44 may have a volume of 6.4 mL. The fitment 38 may be formed of a plastic material, such as, polyethylene, polypropylene, polyethylene terephthalate. In addition, the outside diameter of the tube 38 may be, for example, 6 mm.

In one illustrative approach, when the closure cap 18 is secured or threaded onto the container body 12, the upper surface of the base portion 36 of the fitment 34 abuts an interior surface of the central member 20 such that the tube 38 forms a fluid flow channel 42 to the opening 32 of the central member 20 of the closure cap 18. The tube 38 and the opening 40 in the base portion 36 may be aligned with the opening 32 of the central member 20 of the closure cap 18 when the closure cap 18 is secured to the container body 12. The base portion 36 of the fitment 34 may form a sealed connection with the closure cap 18 when the closure cap 18 is secured to the container body 12 such that fluid is only able to flow from the fitment 34 and through the dispensing opening 32 of the central member 20 and is not able to flow between the base portion 36 of the fitment 34 and the central member 20 of the closure cap 18. In one form, the central member 20 of the closure cap 18 includes an annular seal ring about the opening 32 that engages the upper surface of the base portion 36 about the opening 40 in the base portion 36.

In some configurations, the base portion 36 of the fitment 34 may further include one or more access openings 46 radially outward of the central opening 40. In the embodiment of FIGS. 1A-2B, the base portion 36 includes two partially annular openings 46. The access openings 46 may enable a user to clean out the container body 12 without removing the fitment 34. For example, a user may rinse out the container body 12 by running water through and out of the access openings 46 to rinse, flush, and/or clean the container body 12. The container body 12 may need to be cleaned for reuse and/or for recycling. These access openings 46 may also be used to access the fluid within the container body 12 without dispensing the fluid through the closure cap 18, for example, to fully empty the container body 12.

In some embodiments, the base portion 36 of the fitment 34 also forms a fluid tight seal with the closure cap 18 when the closure cap 18 is secured to the container body 12 to prevent fluid from flowing out of the container body 12 through the access openings 46. For example, portion(s) of the fitment 34 may abut the central member 20 and form a sealed connection therebetween to prevent fluid from unintentionally flowing between the base portion 36 of the fitment 34 and the central member 20 of the closure cap 18. In one form, the closure cap may include seals that are configured to contact the upper surface of the base portion 36 of the fitment 34 about the access openings 46 to prevent fluid from exiting the container body 12 via the access openings 46. In other embodiments, the fitment 34 does not include access openings 46 and is similar to the fitment 334 shown in FIGS. 6A-6B. In some forms, the fitment 34 may be removed from the container body 12 manually, such as, e.g., by using a finger, utensil, or other tool to force the fitment 34 from the container body 12 to access the interior of the container body 12 to empty or clean the interior of the container body 12.

In one exemplary approach, the distal end of the tube 38 of the fitment 34 opposite the base portion 36 may include a diverter cone 50 supported by arms 52 above the inlet opening 41 of the distal end of the tube 38 into the fluid flow channel 42. The diverter cone 50 may aid to prevent separated fluid from falling or flowing into the tube 38 as the dispensing bottle 12 is inverted. For instance, when the dispensing bottle 10 is resting with the neck 14 facing upward, serum or separated fluid may gather on the top surface of the fluid within the container body 12. As the dispensing bottle 10 is inverted, for example, to dispense the fluid, the serum or separated fluid may fall or flow toward the fitment 34 and neck 14 of the container body 12 toward the serum well 44. The diverter cone 50 redirects the fluid toward the serum well 44 and around the tube 38 as the serum passes over the diverter cone 50 and aids to prevent the serum from entering the inlet opening 41 of the tube 38 and being dispensed. The non-separated fluid will flow on top of the serum and trap the serum within the serum well 44. The non-separated fluid will then flow between the diverter cone 50 and the tube 38 and into the inlet opening 41 of the tube 38 through two opposing openings between the arms 52 to dispense the fluid to the user.

In some configurations, the dispensing bottle 10 includes a liner 48 that may be sealed to the rim of the neck 14 of the container body 12 and/or the base portion 36 of the fitment 34. In the embodiment of FIG. 1A, the liner 48 is positioned on top of the fitment 34. The liner 48 may be sealed to the top surface of the base portion 36 of the fitment 34 about the central opening 40 and access openings 46. The liner 48 may seal the contents of the container body 12 therein to prevent spoilage and to prolong the shelf life of the fluid therein. The liner 48 also may further serve as a tamper evident feature, for example, to indicate whether the contents of the container body 12 have been accessed or tampered with. In some embodiments, the liner 48 is an induction seal that is secured to the neck 14 of the container body 12 and/or the base portion 36 of the fitment 34 by induction sealing. The induction sealing may create heat sufficient to weld the base portion 36 of the fitment 34 to the container body 12. The liner 48 may be secured to the fitment 34 and/or the container body 12 such that the liner 48 may be removed, for example, by manually peeling off the liner 48. In some exemplary embodiments, the liner 48 is removed or peeled from a remainder of the bottle without removing the fitment 34. Once the liner 48 is removed, the closure cap 18 may be secured to or re-threaded onto the container body 12 and the fluid dispensed from the dispensing bottle 10.

To dispense fluid from the dispensing bottle 10, the dispensing bottle 10 may be inverted or turned so that the closure cap 18 and the neck 14 of the container body 12 are facing downward below a remainder of the container body 12. As the dispensing bottle 10 is inverted, the separated fluid or serum typically flow toward the base portion 36 of the fitment 34 and into the serum well 44 radially outward of the tube 38 of the fitment 34. The diverter cone 50 typically directs the separated fluid or serum away from the inlet opening 41 of the tube 38 and toward the serum well 44. The non-separated fluid may flow on top of the separated fluid or serum within the serum well 44 thereby trapping the serum and preventing the serum from exiting the container body 12 via the tube 38. Whether before or after the closure cap 18 is placed below the container body 12, the flip-top lid 28 may be opened to remove the projection 29 from the opening 32 in the central member 32 and to thereby permit fluid to exit the container body 12 through the opening 32 in the central member 32 along the fluid flow channel 42. A user may squeeze the container body 12 to force fluid to flow from the container body 12, under the diverter cone 50, into the tube 38 via inlet opening 41, along the fluid flow channel 42, and out the dispensing opening 32.

Figure 3:
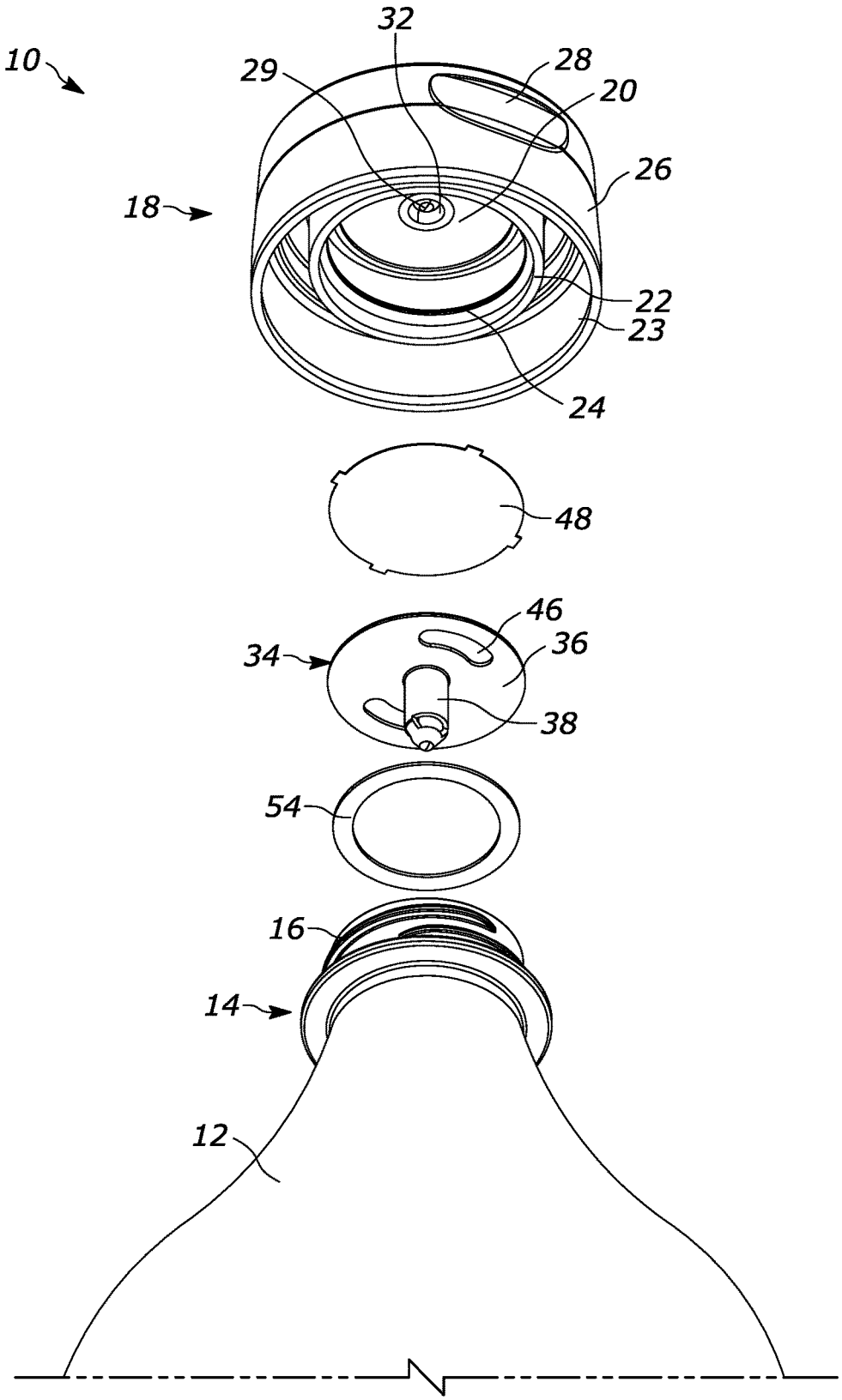
FIG. 3 is a bottom perspective exploded view of a portion of the dispensing bottle of FIG. 1A further including a second liner.

With respect to FIG. 3, the dispensing bottle 10 may further include a second seal 54 between the fitment 34 and the container body 12. The seal 54 may have a donut or ring-shaped configuration and have a diameter that is substantially similar to that of the rim of the neck 14 of the container body 12. The seal 54 may be positioned between the base portion 36 of the fitment 34 and the neck 14 of the container body to form a fluid tight seal therebetween. The seal 54 may be configured such that both sides of the seal 54 are configured to be attached to a surface. The upper side of the seal 54 may be attached to the fitment 34 and the lower side of the seal 54 may be attached to the rim of the neck 14 of the container body 12. In some approaches, the seal 54 is an induction seal configured to adhere to the neck 14 of the container body 12 and/or the fitment 34 during induction sealing. In yet other approaches, the seal 54 includes an adhesive disposed thereon for attachment to the fitment 34 and/or the neck 14 of the container body 12.

Figure 4A:
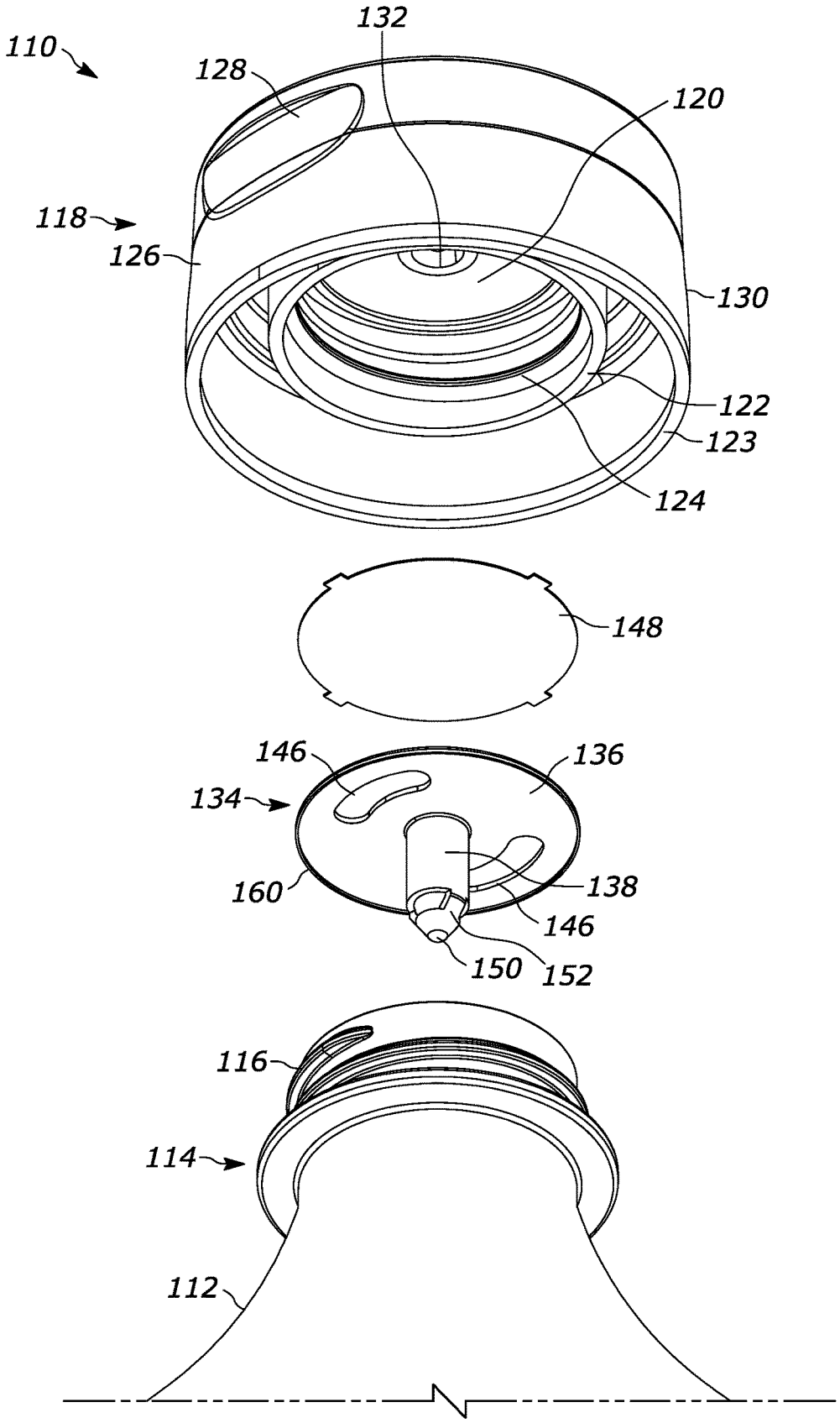
FIG. 4A is a bottom perspective exploded view of a portion of a dispensing bottle according to a second embodiment.
Figure 4B:
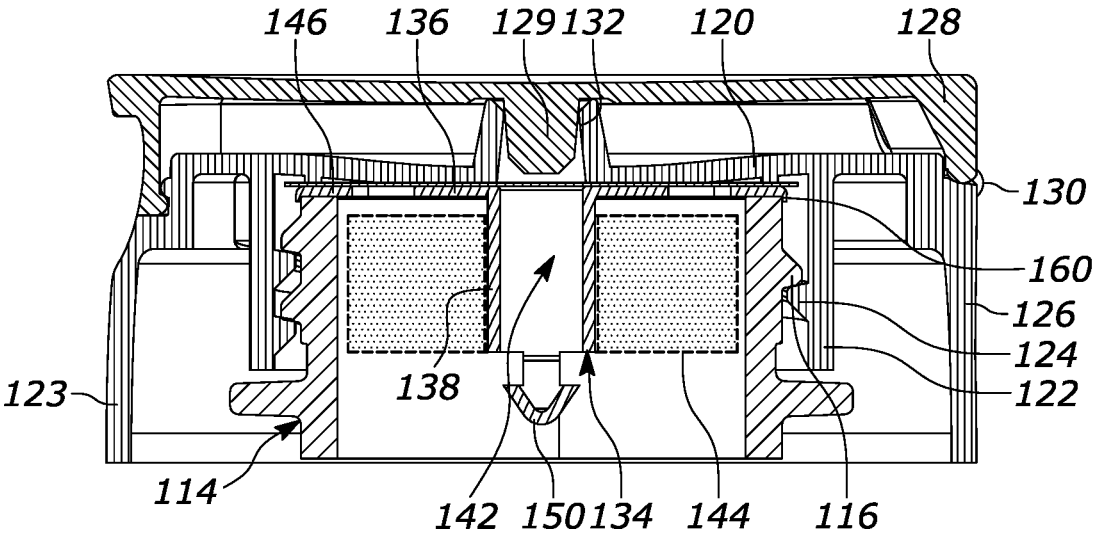
FIG. 4B is a cross-sectional view of the portion of the dispensing bottle of FIG. 4A.

With respect to FIGS. 4A and 4B, a dispensing bottle 110 is shown according to a second embodiment. The dispensing bottle 110 is similar in many respects to that of the dispensing bottle 10 of the first embodiment with the with the differences being highlighted in the following discussion. For conciseness and clarity, the references numeral used for features of the dispensing bottle 10 of the first embodiment that correspond to similar features of the dispensing bottle 110 of the second embodiment will be used with a prefix "1" added to the reference numerals. For example, a feature of the dispensing bottle 10 referenced by the reference numeral "12" will be shown with reference numeral "112" with regard to the dispensing bottle 110. The dispensing bottle 110 includes a container body 112 having a neck 114 with threads 116 thereon. The dispensing bottle 110 includes a closure cap 118 having an inner skirt 122 with threads 124 thereon that are configured to engage the threads 116 of the container body 112 to secure the closure cap 118 to the dispensing bottle 110. The closure cap 118 may be, for example, the same as the closure cap 18 of FIGS. 1A-1E.

The dispensing bottle may include a closure cap 118 that further includes a fitment 134. The fitment 134 includes a base portion 136 including a central opening 140 and one or more access openings 146 radially outward of the central opening 140. The fitment 134 includes a tube 138 extending from the base portion 136 about the central opening 140 such that the tube 138 forms a fluid flow channel 142 within the tube 138 toward the central opening 140 of the base portion 136 of the fitment 134 and a dispensing opening 132 of the closure cap 118 when the closure cap 118 is secured to the container body 112.

With this second embodiment, the base portion 136 of the fitment 134 includes one or more attachment extensions 160 (e.g., one annular extension) about the periphery of the base portion 136 for attaching to a portion of the container body, such as, e.g., the neck 114 of the container body 112. In some forms, the attachment extension 160 aid in aligning the fitment 134 with the neck 114 of the container body 112 and preventing the fitment 134 from moving substantially such that the fitment 134 may be welded to the container body 112. In some forms, the base portion 136 of the fitment 134 may attach to the neck 114 of the container body 112 in a variety of manners, such as, by a snap-fit or friction-fit connection, among others. As shown in FIG. 4B, the overhang, lip, or attachment extension(s) 160 may be extend from the base portion 136 in the same direction as the tube 138 such that the extension(s) 160 may be secured to the outer surface of the neck 114 of the container body 112. While FIG. 4A illustrates the attachment extension 138 being one continuous element, it also may be comprised of more than one discrete rim. By one approach, the attachment extension(s) 160 may snap over the edge of the neck 114 to secure the fitment 134 thereto.

In other forms, the attachment extension(s) 160 may engage or be secured to an inner surface of the neck 114 of the container body 112. In illustrative one form, the attachment extension 160 includes an annular or partially annular attachment wall (or walls) that depend from the base portion 136 of the fitment 134. The attachment wall may include a deflectable angled tip or barb that snaps over a ridge or into a groove that extends about the outer or inner surface of the neck 114 of the container body 112.

In some configurations, the liner 148 may be secured to the upper surface of the base portion 136 of the fitment 134 to seal the contents of the container body 112. Where the attachment extensions 160 attach to the inner surface of the neck 114 of the container body 112, the liner 148 may be attached to the base portion 136 of the fitment 134 and/or the neck 114 of the container body 112. In some forms, the dispensing bottle 10 may further include a second seal (similar to the seal 54 described above) positioned between the base portion 136 of the fitment 134 and the neck 114 of the container body 112.

With respect to FIGS. 5A-5D, a portion 211 of a dispensing bottle is shown according to a third embodiment. The dispensing bottle is similar in many respects to the dispensing bottles of the previous embodiments with the differences being highlighted in the following discussion. For conciseness and clarity, the references numeral used for features of the dispensing bottle 10 of the first embodiment that correspond to similar features of the dispensing bottle of the third embodiment will be used with a prefix "2" added to the reference numerals. For example, a feature of the dispensing bottle 10 referenced by the reference numeral "12" will be shown with reference numeral "212" with regard to the dispensing bottle of this third embodiment. The dispensing bottle includes a container body 212 having a neck 214 with threads 216 thereon. In some configurations, the dispensing bottle includes a closure cap (not shown) that may be similar to the closure caps described above being configured to be attached to the container body 212 by threads that correspond to the threads 216 of the container body 212.

The fitment 234 of the dispensing bottle includes a base portion 236 and a tube 238 extending from the base portion 236 as in the previous embodiments. The fitment 234 is configured to be inserted into the neck 214 of the container body 212 and be held in place by a friction-fit engagement, snap-fit engagement, and/or other connection mechanisms with the interior of the neck 214 of the container body 212. As shown in FIG. 5C, in some embodiments, the interior of the neck 214 includes a cutout or step 214A in the internal edge of the rim, against which the periphery of the base portion 236 of the fitment 234 may abut. For example, the radial outer edge of the base portion 236 may be in frictional engagement with the interior surface of the neck 214. The fitment 234 may be forced into the neck 214 of the container body 212 until the base portion 236 abuts the step 214A. In some configurations, the fitment 234 forms a sealed connection with the neck 214 of the container body 212 to prevent fluid from leaking from the container body 212 between the fitment 234 and the neck 214.

In some approaches, the fitment 234 includes guiding fins 235 depending from the base portion 236 of the fitment 234 that aid in aligning the fitment 234 with the neck 214 of the container body 212. At least a portion of the guiding fins 235 may slide beyond the step 214A of the neck 214 to ensure the fitment 234 is properly oriented and aligned with the neck 214 as the fitment 234 is inserted into the neck 214. The increased axial engagement of the guiding fins 235 with the neck 14 may further aid in preventing the fitment 234 from rotating or pivoting relative to the container body 212 once inserted into the neck 214. The guiding fins 235 may further increase the frictional engagement between the fitment 234 and the container body 212 to aid in preventing the fitment 234 from inadvertently being withdrawn for forced out of the container body 212 once inserted therein.

Figure 5A:
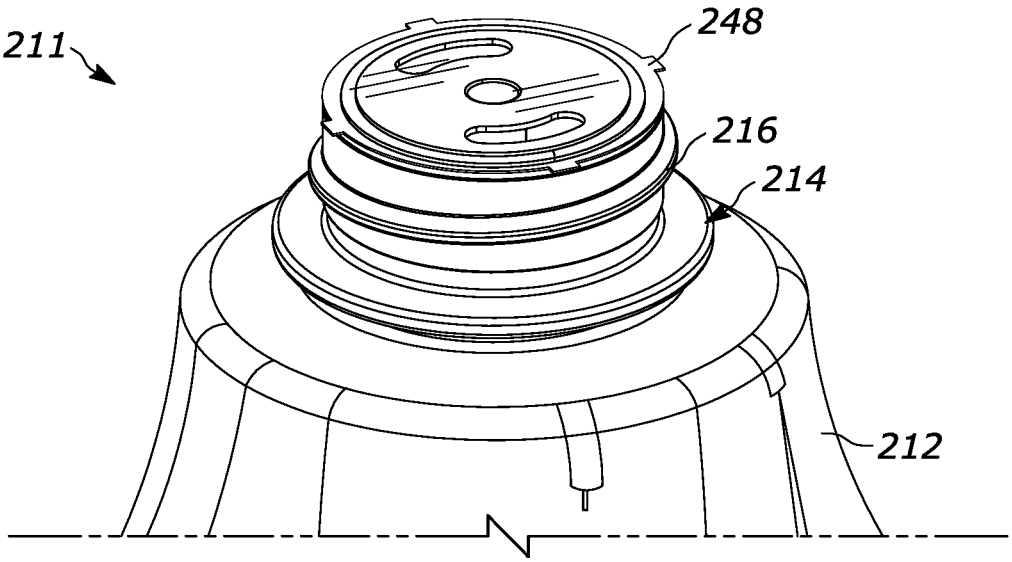
FIG. 5A is a top perspective view of a portion of a dispensing bottle of according to a third embodiment shown without a closure cap.
Figure 5B:
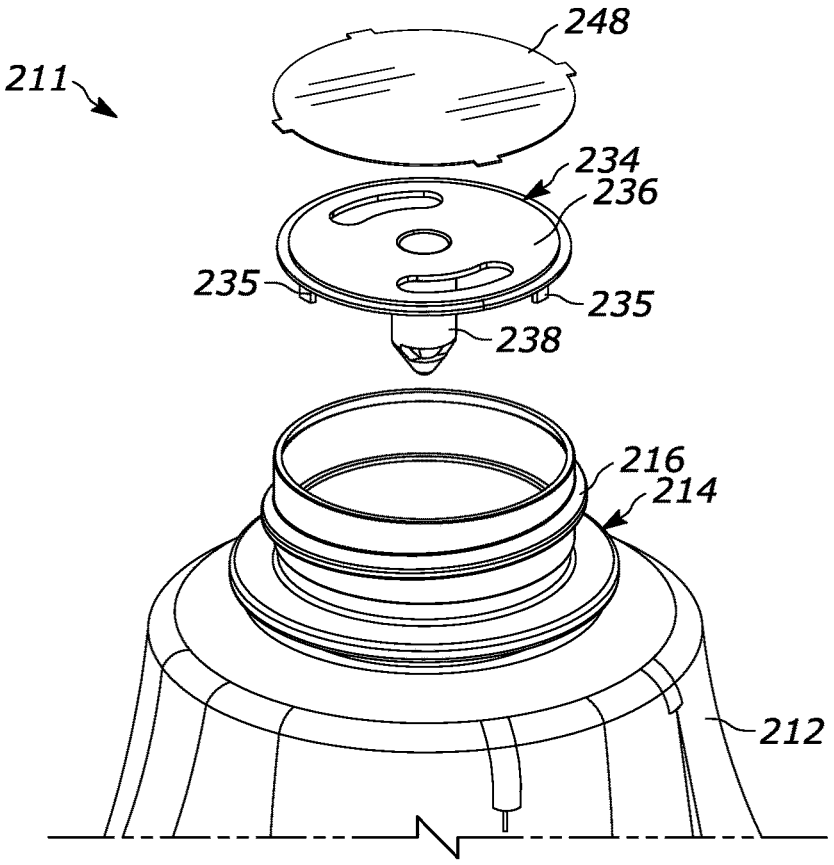
FIG. 5B is a top perspective exploded view of the portion of the dispensing bottle of FIG. 5A shown without the closure cap.
Figure 5C:
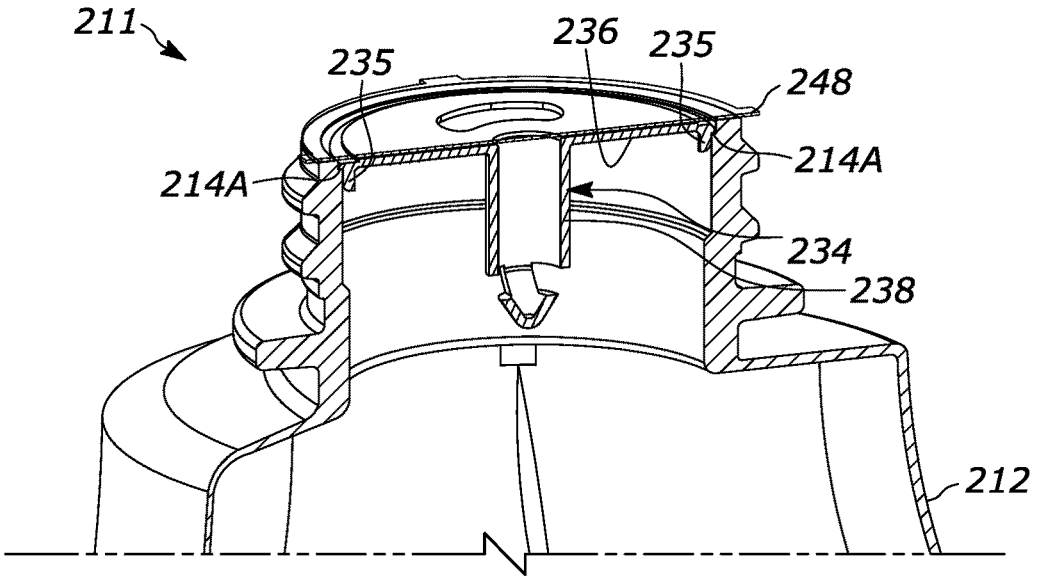
FIG. 5C is a top perspective cross-sectional view of the portion of the dispensing bottle of FIG. 5A shown without the closure cap.
Figure 5D:
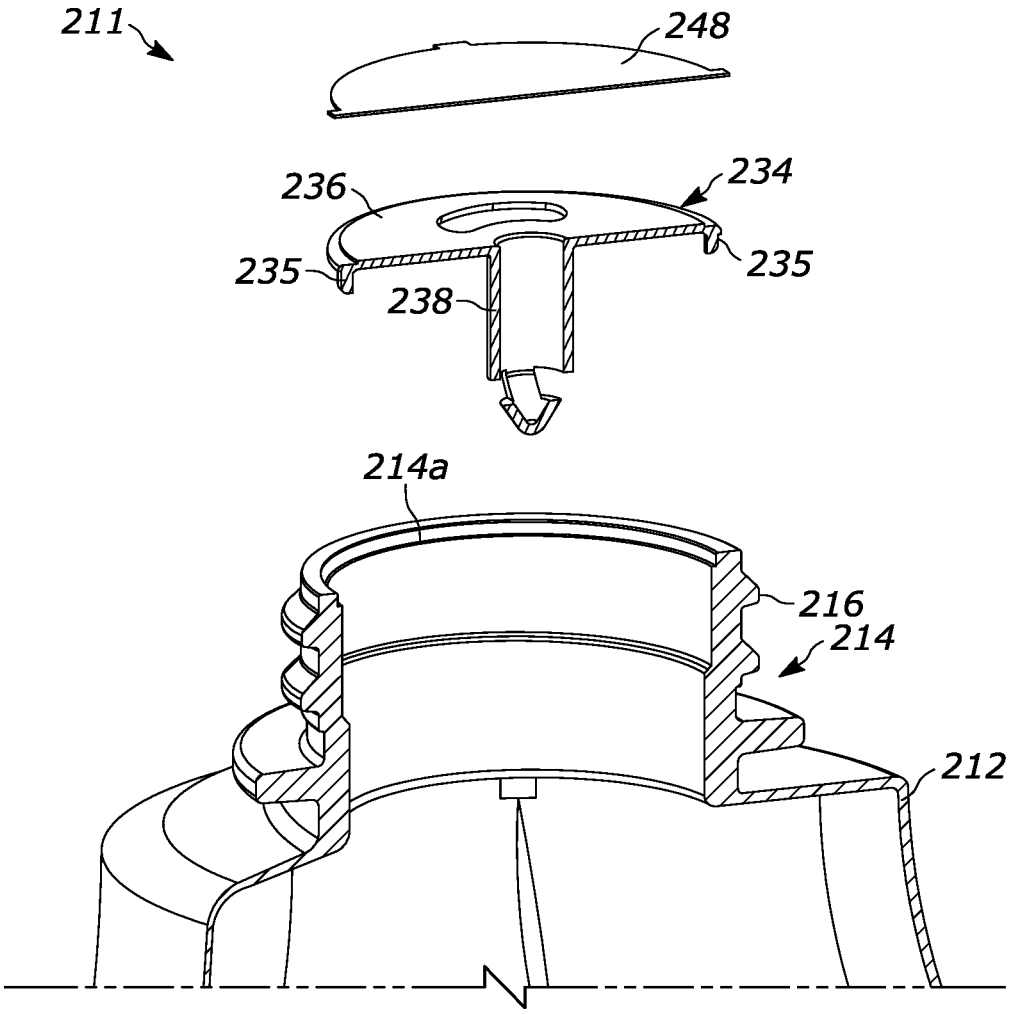
FIG. 5D is a top perspective exploded cross-sectional view of the portion of the dispensing bottle of FIG. 5A shown without the closure cap.

As shown in FIGS. 5A and 5C, the upper surface of the base portion 236 of the fitment 234 may be substantially coplanar with the upper surface of the rim of the neck 214 of the container body 212. Further, in some examples, the liner 248 is secured to the upper surface of the base portion 236 of the fitment 234 and/or the rim of the neck 214 of the container body 212. In some forms, the liner 248 is an induction seal and sealed to the fitment 234 and/or container body 212 by induction sealing. In other forms, the liner 248 is sealed to the fitment 234 and/or container body 212 by an adhesive.

In some forms, the inner surface of the neck 214 of the container body 212 includes an annular or partially annular groove that receives the radial outer edge of the base portion 236 of the fitment 234. The fitment 234 may be inserted into the neck 214 of the container body 212 until a peripheral edge of the base portion 236 of the fitment 234 snaps into the groove of the neck 214 to secure the fitment 234 to the container body 214 by a snap-fit connection.

Figure 6A:
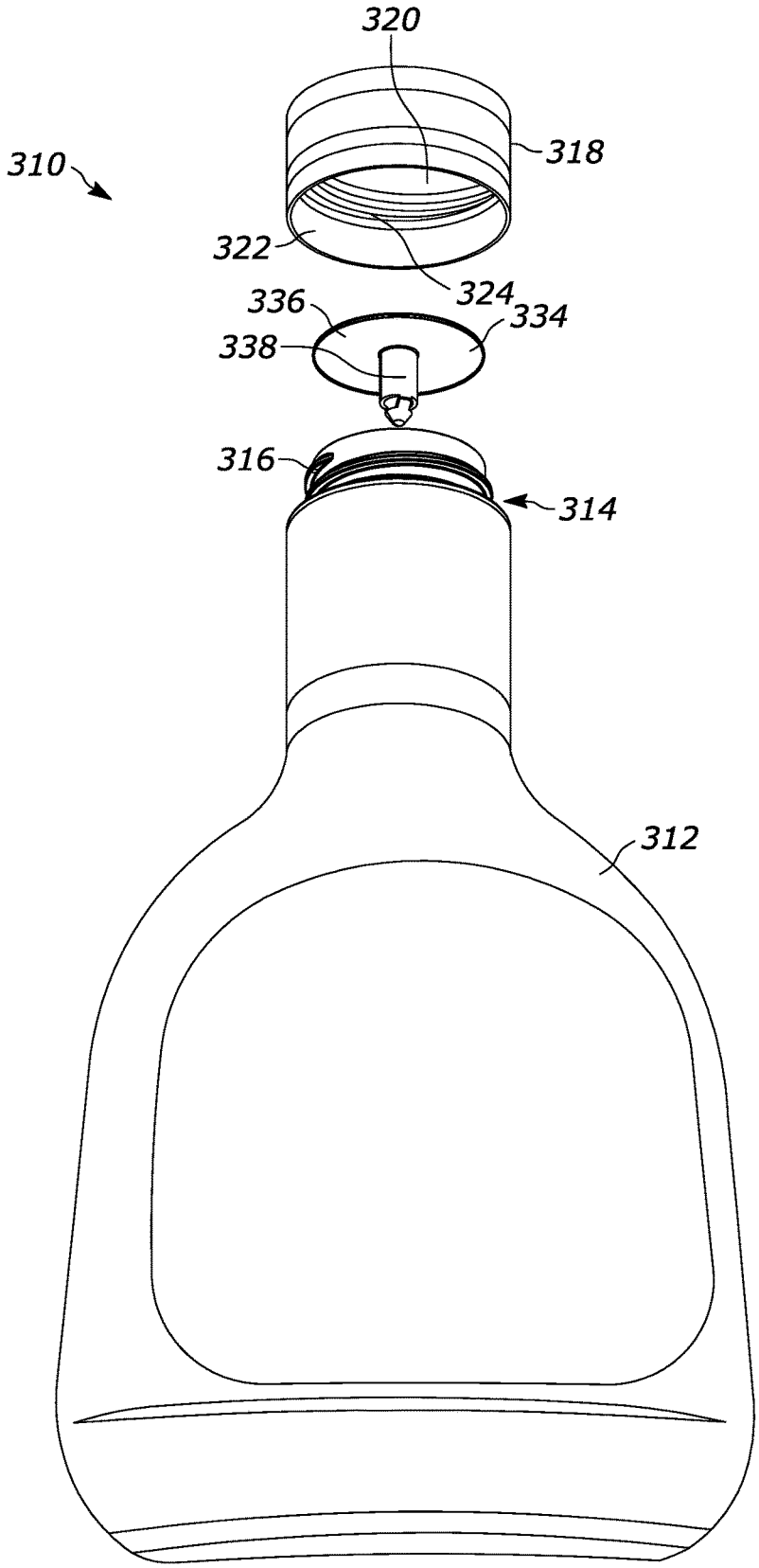
FIG. 6A is a bottom perspective exploded view of a dispensing bottle according to a fourth embodiment.
Figure 6B:
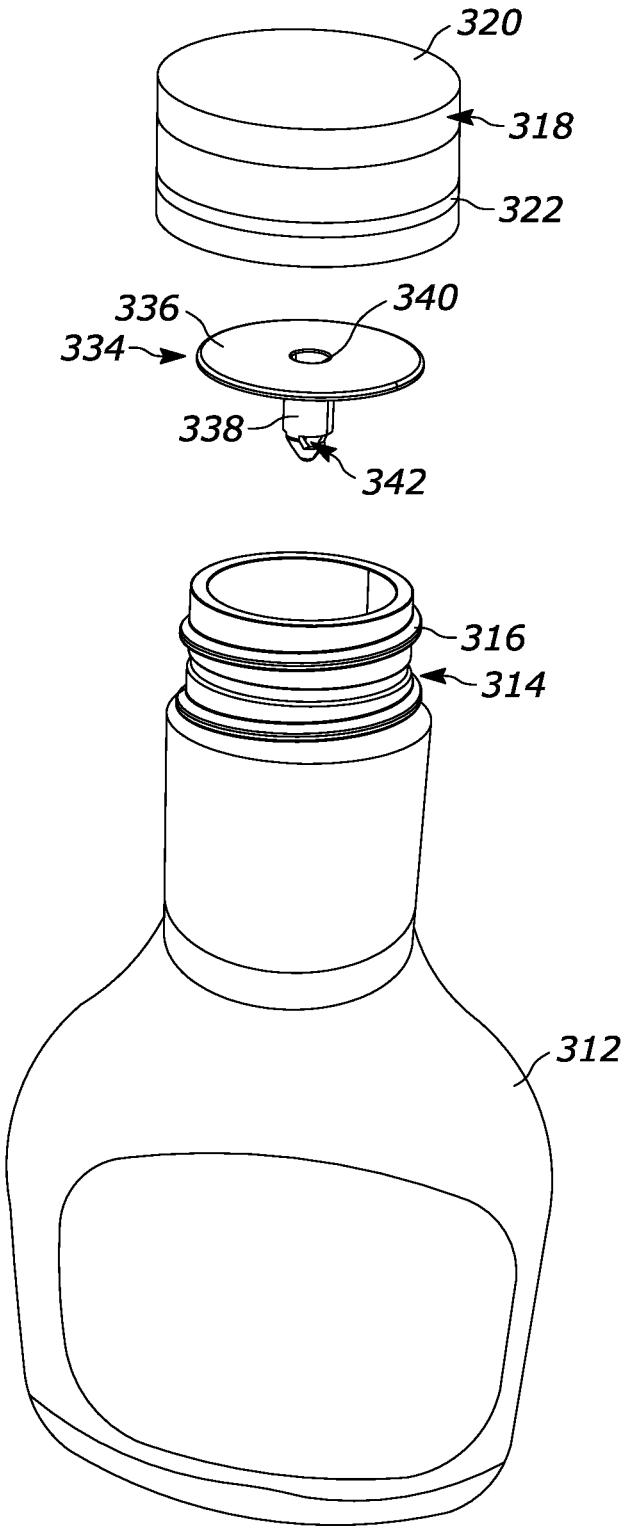
FIG. 6B is a top perspective exploded view of the dispensing bottle of FIG. 6A.

With respect to FIGS. 6A and 6B, a dispensing bottle 310 is shown according to a fourth embodiment. The dispensing bottle 310 is similar to the dispensing bottles of the previous embodiments with the differences being highlighted in the following discussion. For conciseness and clarity, the references numeral used for features of the dispensing bottle 10 of the first embodiment that correspond to similar features of the dispensing bottle 310 of the fourth embodiment will be used with a prefix "3" added to the reference numerals. For example, a feature of the dispensing bottle 10 referenced by the reference numeral "12" will be shown with reference numeral "312" with regard to the dispensing bottle 310. The dispensing bottle 310 includes a container body 312 having a neck 314 with neck threads 316 thereon. The dispensing bottle includes a closure cap 318 having a central member 320 with a skirt 322 depending from the central member 320. The skirt 322 includes threads 324 thereon for securing the closure cap 318 to the neck 314 of the container body 312. The closure cap 318 may include only a single skirt 322 and not include an outer skirt forming an outer shell about the neck as, for example, in the dispensing bottle 10 of the first embodiment. The closure cap 318 does not include a flip-top lid and the central member 320 of the closure cap 318 does not include an opening therethrough for dispensing the fluid within the container body 312. Instead, the closure cap 318 may be removed (e.g., unthreading the closure cap 318) from the container body 312 to dispense the fluid through the fitment 334.

The fitment 334 may be similar to the fitments of the previous embodiments including a base portion 336 and a tube 338. The base portion 336 of the fitment 334 may be configured to be attached to the neck 314 of the container body 312 as described with respect to any of the previous embodiments. The fitment 334 may include a central opening 340 from which a tube 338 may extend to form a fluid flow channel 342 through which the fluid may be dispensed from the container body 312. In the embodiment shown, the base portion 336 of the fitment 334 does not include access openings as in the prior embodiments. This ensures that fluid only exits the container body 312 through the central opening 340 of the fitment 334. The fitment 334 may be removeable from the container body 312 (e.g., by unsnapping or forcing the fitment from the container body) to allow a user to fully empty the container body 312 and/or to rinse the container body 312.

Figure 7A:
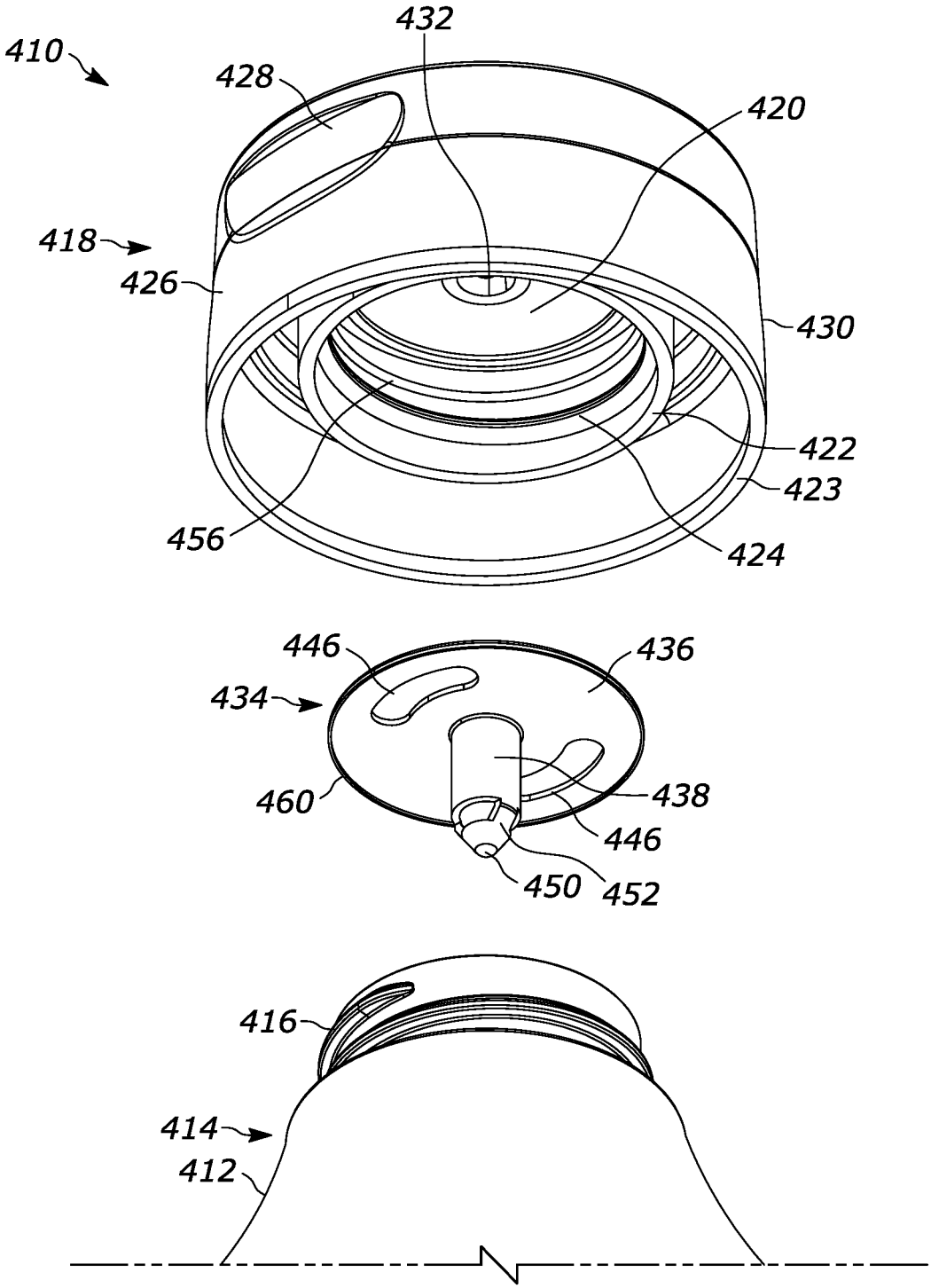
FIG. 7A is a bottom perspective exploded view of a portion of a dispensing bottle according to a fifth embodiment.
Figure 7B:
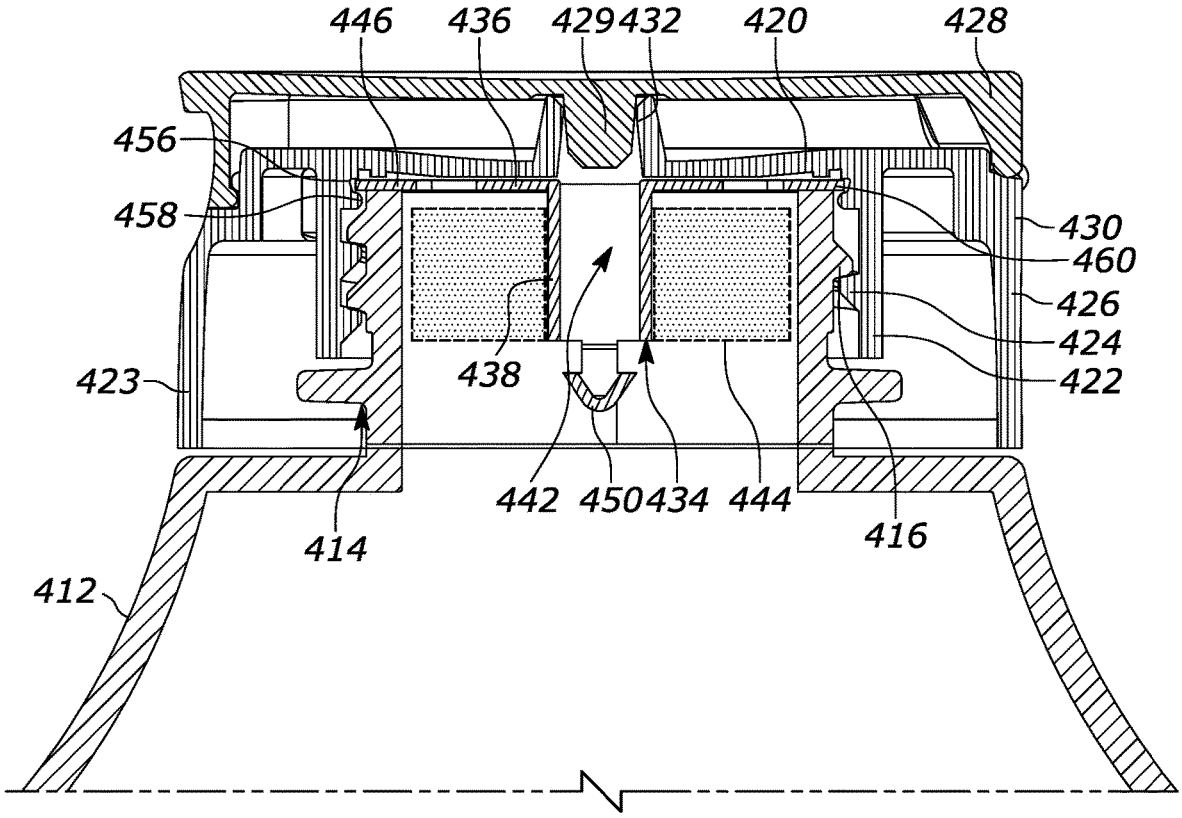
FIG. 7B is a cross-sectional view of a portion of the dispensing bottle of FIG. 7A.

With respect to FIGS. 7A and 7B, a dispensing bottle 410 is shown according to a fifth embodiment. The dispensing bottle 410 is similar to the dispensing bottles of the previous embodiments with the differences being highlighted in the following discussion. For conciseness and clarity, the references numeral used for features of the dispensing bottle 10 of the first embodiment that correspond to similar features of the dispensing bottle 410 of the fifth embodiment will be used with a prefix "4" added to the reference numerals. For example, a feature of the dispensing bottle 10 referenced by the reference numeral "12" will be shown with reference numeral "412" with regard to this embodiment. With the dispensing bottle 410 of FIGS. 7A and 7B, the fitment 434 attaches directly to the closure cap 418 rather than being directly attached to the container body 12 as in the previous embodiments.

The fitment 434 may be attached to the closure cap 18 by a snap-fit and/or friction fit connection, among other options. In some configurations, the closure cap 418 includes a groove 456 (FIG. 7B) extending along the inner surface of the inner skirt 422 about the circumference of the inner skirt 422. The fitment 434 may be snapped into the groove 456 to secure the fitment 434 to the closure cap 18. The inner skirt 422 may further include a ridge 458 extending adjacent to the groove 456 that the fitment 434 is forced to pass over to snap the fitment 434 into the groove 456. The ridge 458 may aid to retain the fitment 434 in position once attached to the closure cap 18 and to prevent the fitment 434 from unintentionally becoming detached from the closure cap 418. To attach the fitment to the closure cap 18, the fitment 434 may be aligned with the cavity formed by the inner skirt 422 and inserted within the inner skirt 422 to bring the base portion 436 of the fitment 434 toward the central member 420 of the closure cap 418. The peripheral edge of the fitment 434 may be brought into engagement with the ridge 458 and forced to pass over the ridge 458 to the groove 458. The base portion 436 of the fitment 434 may flex and/or compress as the fitment 434 is forced against the ridge 458 until the base portion 436 of the fitment 434 passes beyond the ridge 458. The base portion 436 of the fitment 434 may spring back or elastically return to its original shape with the peripheral edge of the base portion 436 of the fitment within the groove 456 of the closure cap 418. Once inserted into the closure cap 18, the base portion 436 of the fitment 434 catches or hooks the ridge 458 forming the groove 456 thereby preventing the fitment 434 from separating from the closure cap 18.

In some forms, the base portion 436 of the fitment 434 may additionally or alternatively be secured to the closure cap 18 by an adhesive. For example, an adhesive may secure the upper surface of the base portion 436 of the fitment 434 to the central member 420 of the closure cap 18. In some forms, the closure cap 18 does not include a groove 456 or ridge 448. Additionally or alternatively, the fitment 434 may be held within the inner skirt 422 of the closure cap 418 by frictional engagement of the peripheral edge of the base portion 436 of the fitment 434 with the inner surface of the inner skirt 422. In other forms, the fitment 434 is formed integrally or as a unitary piece with the closure cap 18. For instance, the fitment 434 is molded as a single piece with the closure cap 18. For example, the closure cap 18 may include a tube (similar to tube 438 of the fitment 434) depending from the central member 420 of the closure cap 18 about the dispensing opening 432.

The dispensing bottle 410 also differs from prior embodiments in that the dispensing bottle 410 typically does not include a liner between the fitment 434 and the closure cap 418. The closure cap 418 may form a sealed connection with the container body 12 using other approaches that do not require a seal liner over the opening of the fitment 434. For example, the dispensing opening 432 of the closure cap 418 may include a removeable seal that seals the opening before use. The closure cap 418 may form also form a sealed connection with the container body 412 when attached thereto (e.g., between the inner skirt 422 and the neck 414 of the container body 412). In other configurations, a seal may be disposed below the closure cap and the fitment at the neck of a bottle.

In each of the above embodiments, the length and diameter of the tube 38 of the fitment 34 may be adjusted based on the type of fluid to be dispensed from the dispensing bottle 10. For example, for higher viscosity fluids, a larger diameter tube 38 may be used. As another example, for fluids that are prone to separation a longer tube 38 may be used to create a greater volume serum well 44 such that fluid from further within the container body 12 is dispensed. Thus, the size of the fitment 34 may be selected based on the type of fluid that will be within the dispensing bottle 10. For example, a fitment 34 may be used that has a tube 38 that is optimized for a particular fluid type based on the fluid properties and separation characteristics of the fluid. The closure cap 18 may be compatible with several fitments 34 having different sized tubes 38 such that the closure cap 18 may be used for fluids of all types with the type of fitment 34 being selected and used based on the type of fluid to be dispensed from the container body 12. For example, the same container body 12 and closure cap 18 may be used for dispensing several different condiments (e.g., ketchup, barbeque, mustard, etc.) with the fitment 34 (e.g., the size of the tube 38 of the fitment 34) varying based on the condiment within the container body 12. With respect to the dispensing bottle 410 of FIGS. 7A and 7B, fitments 34 of varying sizes may be compatible with the closure cap 18 such that fitments of varying sizes may be attached to the closure cap 18 based on the fluid.

The dispensing bottle 10 may be manufactured according to the following processes. While the following discussion primarily makes reference to the dispensing bottle 10 of the first embodiment, those having skill in the art will readily appreciate that these steps may also apply to the dispensing bottles of the other embodiments. The container body 12 may be molded as a receptacle having an interior volume for receiving and storing fluid therein. The container body 12 may be molded to include a neck 14 with threads thereon for securing the container body 12 to the closure cap 18. The container body 12 may be filled with a fluid product such as a thixotropic fluid through to opening in the neck 14 of the container body 12. The closure cap 18 may be molded to form a cap including base 26 having a central member 20 with a skirt 22 depending from the central member 20. The skirt 22 includes threads 24 thereon that correspond to the neck threads 16 to enable the closure cap 18 to be secured to the neck 14 of the container body 12. In some forms, the central member 20 of the closure cap 18 may form a portion of the base 26 to which the flip-top lid 28 is hingedly connected to via hinge 30. The central member 20 may also be formed with a dispensing opening 32 therein.

Figure 1B:
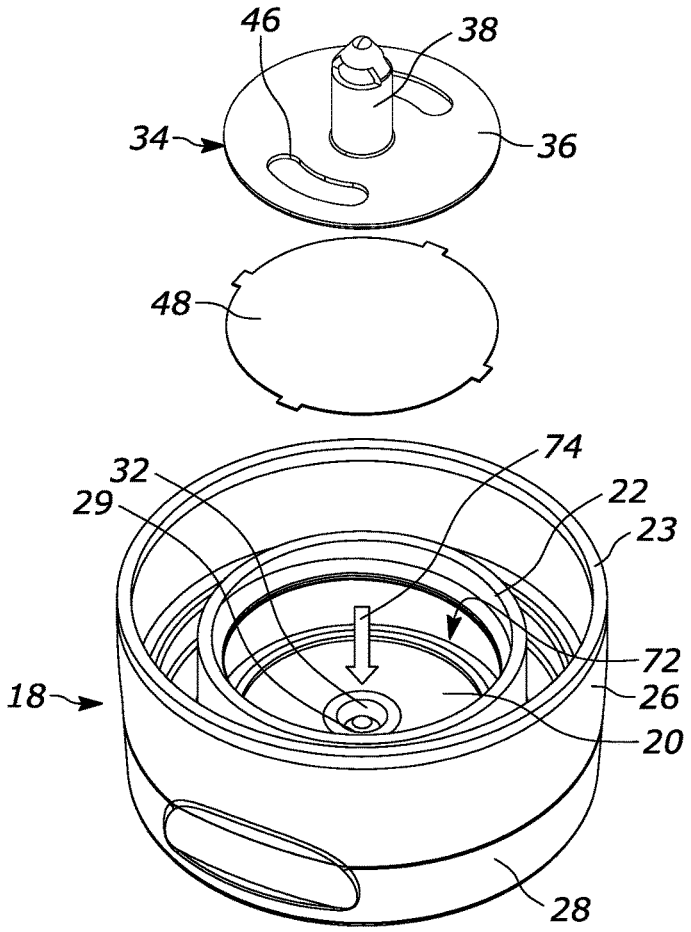
FIG. 1B is a bottom perspective view of the closure cap of FIG. 1A including a cavity for receiving the liner and the fitment.
Figure 1C:
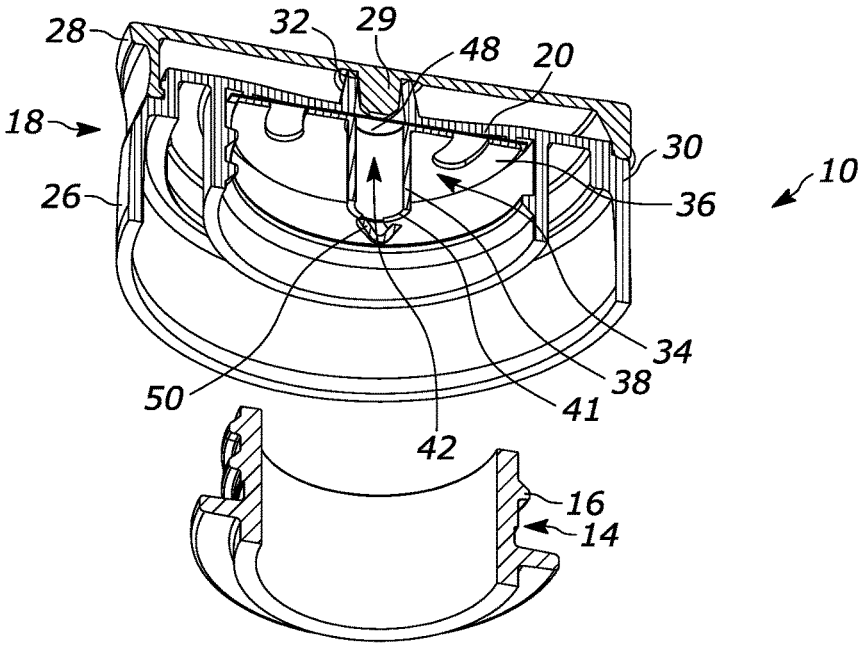
FIG. 1C is a bottom perspective cross-sectional view of a portion of the dispensing bottle of FIG. 1A shown with the container body separated from the closure cap including the liner and fitment.
Figure 1D:
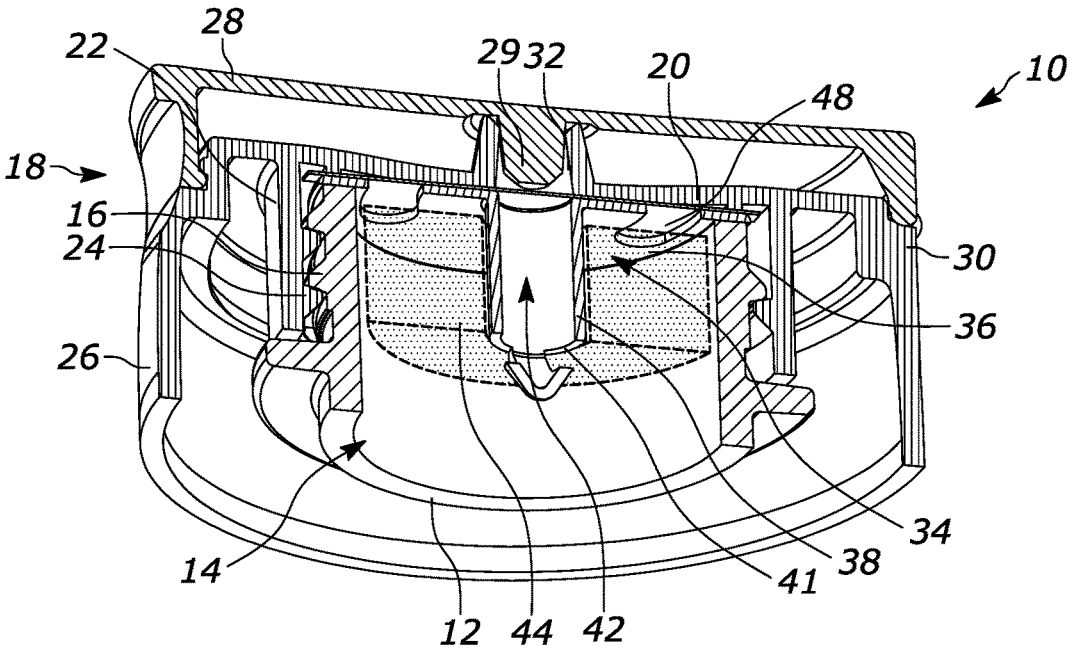
FIG. 1D is a bottom perspective cross-sectional view of a portion of the dispensing bottle of FIG. 1A showing the closure cap secured to the container body.
Figure 1E:
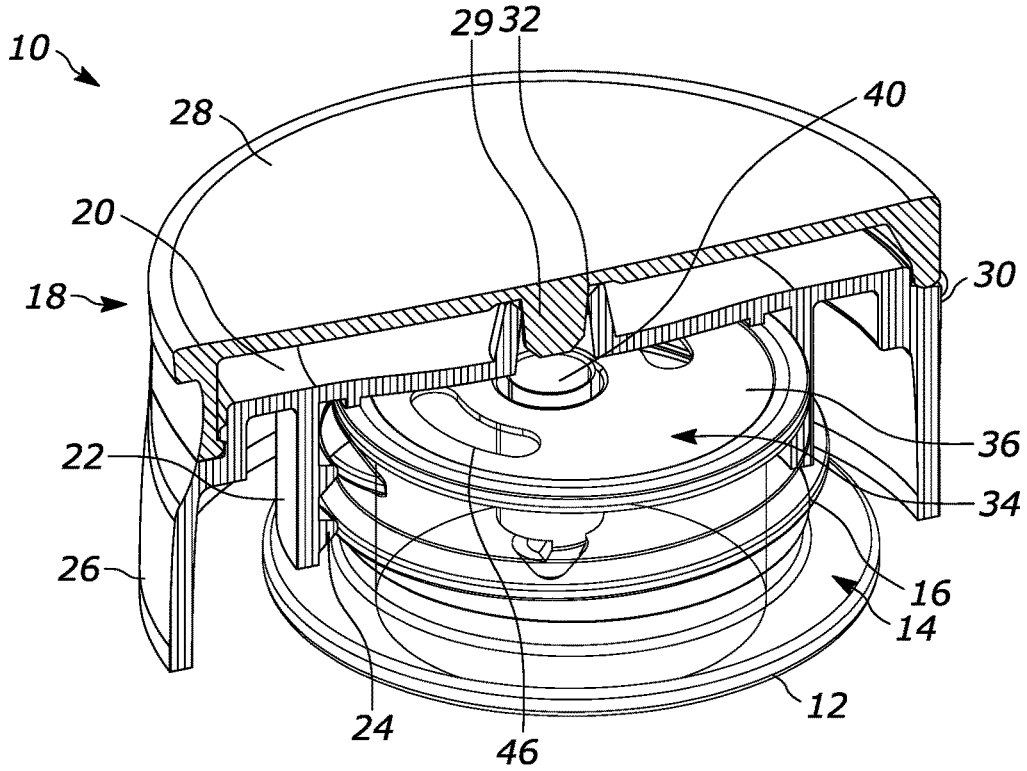
FIG. 1E is a top perspective partial cross-sectional view of a portion of the dispensing bottle of FIG. 1A showing the closure cap secured to the container body.

A seal liner 48 may be positioned within a recess 72 of the closure cap 18 formed by the central member 20 and the skirt 22 as shown by arrow 74 of FIG. 1B. The fitment 34 may be positioned within the recess 72 of the closure cap 18, by inserting the fitment 34 as shown by arrow 74 of FIG. 1B, with the upper surface of the fitment 34 engaging the lower surface of the liner 48 and the tube 38 of the fitment 34 extending away from the liner 48. In some forms, the second seal 54 is positioned within the recess 72 of the closure cap 18 on the lower surface of the base portion 36 of the fitment 34.

The closure cap 18 may be attached to the neck 14 of the container body 12 with the liner 48 and the fitment 34 within the recess 72 of the closure cap 18. As the closure cap 18 is attached to the container body 12, the tube 38 of the fitment 34 may be aligned with and inserted into the opening of the container body 12 formed by the neck 12. The liner 48 may be sealed to at least one of the neck 14 of the container body 12 and/or the fitment 34. As one example, the dispensing bottle 10 may undergo induction sealing to seal the liner 48 to the fitment 34. In embodiments where the second seal 54 is used, the second seal 54 may be sealed to the neck 14 of the container body 12 and the base portion 36 of the fitment 34. In some forms, the liner 48 and the second seal 54 are sealed simultaneously by an induction sealing process.

In forms where the second seal 54 is not used, the induction sealing of the liner 48 may cause the base portion 36 of the fitment 34 to be welded to the neck 14 of the container body 12. In embodiments where the fitment 34 is attached to the neck 14 of the container body 12 by a friction-fit and/or snap-fit connection, the fitment 34 may be inserted into and/or attached to the container body 12 as the closure cap 18 is threaded to the neck 14 of the container body 12. As one example, the attachment extension(s) 160 of the embodiment of FIGS. 4A and 4B may snap onto the neck 14 of the container body 12 as the closure cap 18 is secured to the container body 12. As another example, where the inner surface of the neck 14 of the container body 12 includes a groove for receiving the peripheral edge of the fitment 34, as the closure cap 18 is secured to the container body 12, the peripheral edge of the fitment 34 may snap into the groove of the neck 14 to secure the fitment 34 to the container body 12.

To use the dispensing bottle 10, a user may remove the closure cap 18 and then remove the liner 48 from the fitment 34 and/or the neck 14 of the container body 12. In some embodiments, the closure cap 18 is reattached to the container body 12 and the flip-top lid 28 moved to the open position. The dispensing bottle 10 may then be inverted and squeezed to dispense fluid through the dispensing opening 32 of the closure cap 18. In some embodiments, such as the dispensing bottle 310 of FIGS. 6A-6B, the cap 318 is not reattached to the dispensing bottle 310 prior to dispensing fluid. Instead, the dispensing bottle 310 may be inverted and squeezed to dispense fluid from the dispensing bottle 310 directly through the fitment 334. In each of the above embodiments, when the dispensing bottle 10 is inverted, the separated fluid flows into the serum well 44 around the tube 38 of the fitment 34. The separated fluid is thus not able to flow out of the dispensing bottle 10 through the inlet opening 41 of the tube 38. Thus, mixed or non-separated fluid is dispensed without dispensing any separated fluid that may be in the container. As the fluid flows within the container body 12 during dispensing, the separated fluid within the serum well 44 may be remixed in with the remainder of the fluid.

Uses of singular terms such as "a," "an," are intended to cover both the singular and the plural, unless otherwise indicated herein or clearly contradicted by context. The terms "comprising" "having," "including" and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described particular embodiments of the present invention, those skilled in the art will recognize that a wide variety of modifications, alterations, and combinations can be made with respect to the above-described embodiments without departing from the scope of the invention, and that such modifications, alterations, and combinations are to be viewed as being within the ambit of the inventive concept.

What is claimed is:

1. A dispensing bottle comprising:

a container body having a neck forming an opening and neck threads thereon;

a closure cap having a central member and a skirt dependent from the central member, the skirt having threads corresponding to the neck threads to thereby secure the closure cap relative to the container body;

a fitment including a base portion and a tube, the base portion attached to the neck of the container body and including at least one opening therethrough and the tube extending from the base portion and into the container body, the tube forming a fluid flow channel within the neck of the container body to the opening of the base portion of the fitment to form a serum well within the neck of the container body;

wherein an end of the tube opposite the base portion of the fitment includes a pair of opposing openings at a diverter cone supported at the end of the tube opposite the base portion of the fitment; and a liner sealed to at least one of a rim of the neck of the container body and the base portion of the fitment.

2. The dispensing bottle of claim 1 wherein the base portion of the fitment is secured to the neck of the container body by a snap-fit or friction-fit connection.

3. A dispensing bottle comprising:

a container body having a neck forming an opening and neck threads thereon;

a closure cap having a central member and a skirt dependent from the central member, the skirt having threads corresponding to the neck threads to thereby secure the closure cap relative to the container body;

a fitment including a base portion and a tube, the base portion attached to the neck of the container body and including at least one opening therethrough and the tube extending from the base portion and into the container body, the tube forming a fluid flow channel within the neck of the container body to the opening of the base portion of the fitment to form a serum well within the neck of the container body;

a liner sealed to at least one of a rim of the neck of the container body and the base portion of the fitment; and wherein the base portion of the fitment is secured to the neck of the container body by a snap-fit or friction-fit connection and an inner surface of the neck includes a groove and a periphery of the base portion of the fitment snaps into the groove.

4. The dispensing bottle of claim 3 wherein the fitment includes an attachment portion extending from the base portion of the fitment, the attachment portion engaging the neck of the container body to secure the fitment thereto.

5. The dispensing bottle of claim 4 wherein the attachment portion engages an outer surface of the neck of the container body.

6. A dispensing bottle comprising:

a container body having a neck forming an opening and neck threads thereon;

a closure cap having a central member and a skirt dependent from the central member, the skirt having threads corresponding to the neck threads to thereby secure the closure cap relative to the container body;

a fitment including a base portion and a tube, the base portion attached to the neck of the container body and including at least one opening therethrough and the tube extending from the base portion and into the container body, the tube forming a fluid flow channel within the neck of the container body to the opening of the base portion of the fitment to form a serum well within the neck of the container body;

a liner sealed to at least one of a rim of the neck of the container body and the base portion of the fitment; and a second seal between the rim of the neck of the container body and the base portion of the fitment.

7. The dispensing bottle of claim 6 wherein the second seal is substantially ring-shaped and secures the base portion of the fitment to the neck of the container body and the liner is peelable from the at least one of the rim of the neck of the container body and a portion of the base portion of the fitment.

8. The dispensing bottle of claim 1 wherein the liner is secured to the base portion of the fitment and the base portion of the fitment is secured to a portion of the container body.

9. The dispensing bottle of claim 1 wherein the liner is secured to at least one of the neck of the container body and the base portion of the fitment by an induction seal.

10. The dispensing bottle of claim 9 wherein the base portion of the fitment is welded to the neck of the container body during induction sealing.

11. A dispensing bottle comprising:

a container body having a neck forming an opening and neck threads thereon;

a closure cap having a central member and a skirt dependent from the central member, the skirt having threads corresponding to the neck threads to thereby secure the closure cap relative to the container body;

a fitment including a base portion and a tube, the base portion attached to the neck of the container body and including at least one opening therethrough and the tube extending from the base portion and into the container body, the tube forming a fluid flow channel within the neck of the container body to the opening of the base portion of the fitment to form a serum well within the neck of the container body; and a liner sealed to at least one of a rim of the neck of the container body and the base portion of the fitment;

wherein the at least one opening of the base portion of the fitment further includes a central opening and at least one annular opening therethrough permitting access into the container body when the closure cap is removed from the container body.

12. The dispensing bottle of claim 1 wherein the liner is peelably removable from the at least one of the container body and the fitment, while the fitment remains secured to the container body.

13. The dispensing bottle of claim 1 wherein the closure cap includes a base and a flip-top lid hingedly connected to the base, the base including the central member and the central member including an opening for fluid to flow through, wherein the tube of the fitment forms the fluid flow channel to the opening of the central member of the closure cap when the closure cap is attached to the container body.

14. The dispensing bottle of claim 13 wherein the base portion of the fitment includes an upper surface for engaging the base of the closure cap when the closure cap is attached to the container body such that the tube portion is aligned with the opening of the closure cap such that fluid flows through the tube of the fitment to the opening of the closure cap.

15. A dispensing bottle comprising:

a container body having a neck forming an opening and neck threads thereon;

a closure cap having a central member and a skirt dependent from the central member, the skirt having threads corresponding to the neck threads to thereby secure the closure cap relative to the container body;

a fitment including a base portion and a tube, the base portion attached to the neck of the container body and including at least one opening therethrough and the tube extending from the base portion and into the container body, the tube forming a fluid flow channel within the neck of the container body to the opening of the base portion of the fitment to form a serum well within the neck of the container body; and a liner sealed to at least one of a rim of the neck of the container body and the base portion of the fitment;

wherein the closure cap includes an outer shell around the skirt of the base.

16. A method of manufacturing a dispensing bottle comprising:

molding a receptacle having a neck with threads thereon;

molding a closure cap including a base, the base including a skirt with base threads configured to engage the threads of the receptacle;

positioning a seal liner within a recess of the base of the closure cap;

positioning a fitment within the recess of the base of the closure cap, the fitment having a base portion and a tube extending from the base portion;

attaching the closure cap to the receptacle such that the tube of the fitment extends into the receptacle, wherein the fitment is attached to the neck of the receptacle via a snap-fit connection; and sealing the seal liner to at least one of the neck of the receptacle and the fitment by an induction seal.

17. The method of claim 16 wherein sealing the seal liner to the neck of the receptacle welds the base portion of the fitment to the neck of the receptacle.

18. The method of claim 17 wherein an inner surface of the neck of the receptacle includes a groove and wherein a periphery of the base portion of the fitment snaps into the groove to attach the fitment to the neck of the receptacle.

19. A method of manufacturing a dispensing bottle comprising:

molding a receptacle having a neck with threads thereon;

molding a closure cap including a base, the base including a skirt with base threads configured to engage the threads of the receptacle;

positioning a seal liner within a recess of the base of the closure cap;

positioning a fitment within the recess of the base of the closure cap, the fitment having a base portion and a tube extending from the base portion;

attaching the closure cap to the receptacle such that the tube of the fitment extends into the receptacle;

sealing the seal liner to at least one of the neck of the receptacle and the fitment by an induction seal; and positioning a seal within the recess of the base of the closure cap and sealing the seal between the base portion of the fitment and the neck of the receptacle.

20. The dispensing bottle of claim 6 wherein the base portion of the fitment is secured to the neck of the container body by a snap-fit or friction-fit connection and an inner surface of the neck includes a groove and a periphery of the base portion of the fitment snaps into the groove.

21. The dispensing bottle of claim 11 wherein the base portion of the fitment is secured to the neck of the container body by a snap-fit or friction-fit connection and an inner surface of the neck includes a groove and a periphery of the base portion of the fitment snaps into the groove.

22. The dispensing bottle of claim 1 further comprising a second seal between the rim of the neck of the container body and the base portion of the fitment.

23. The dispensing bottle of claim 11 further comprising a second seal between the rim of the neck of the container body and the base portion of the fitment.

24. The dispensing bottle of claim 6 wherein the tube of the fitment further comprises a cone-shaped extension.

25. The dispensing bottle of claim 11 wherein the tube of the fitment further comprises a cone-shaped extension.

* * * * *